US009236670B2

(12) United States Patent
Nishikawa et al.

(10) Patent No.: US 9,236,670 B2
(45) Date of Patent: Jan. 12, 2016

(54) COAXIAL CONNECTOR

(71) Applicant: Molex, LLC, Lisle, IL (US)

(72) Inventors: Masako Nishikawa, Yamato (JP); Toshiya Oda, Yokohama (JP); Ayako Ida, Yamato (JP); Yusuke Shibata, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/564,288

(22) Filed: Dec. 9, 2014

(65) Prior Publication Data

US 2015/0162673 A1 Jun. 11, 2015

(30) Foreign Application Priority Data

Dec. 9, 2013 (JP) ..... 2013-254323

(51) Int. Cl.
*H01R 9/05* (2006.01)
*H01R 13/627* (2006.01)
*H01R 24/50* (2011.01)

(52) U.S. Cl.
CPC ..... *H01R 9/0518* (2013.01); *H01R 13/6277* (2013.01); *H01R 24/50* (2013.01)

(58) Field of Classification Search
CPC ..... H01R 9/0518; H01R 13/627; H01R 13/6277; H01R 24/50
USPC ..... 439/63, 253, 257, 578
See application file for complete search history.

(56) References Cited

U.S. PATENT DOCUMENTS

| | | | | |
|---|---|---|---|---|
| 8,758,050 | B2 * | 6/2014 | Montena | H01R 9/05 439/357 |
| 8,986,043 | B2 * | 3/2015 | Hirakawa | H01R 24/46 439/188 |
| 8,986,044 | B2 * | 3/2015 | Meister | H01R 9/0503 439/578 |
| 9,004,931 | B2 * | 4/2015 | Montena | H01R 9/0524 439/253 |
| 9,022,799 | B2 * | 5/2015 | Sorolla Rosario | H01R 13/005 439/485 |
| 2013/0115810 | A1 | 5/2013 | Maruyama et al. | |

* cited by examiner

*Primary Examiner* — Khiem Nguyen
(74) *Attorney, Agent, or Firm* — James A. O'Malley

(57) ABSTRACT

The coaxial connector of the Present Disclosure includes a tube-shaped outer conductor, an insulating portion and an inner conductor. The insulating portion has a first fixed portion, a first elastic portion positioned on one side of the first fixed portion, and a second elastic portion. The inner conductor has a second fixed portion, a first holding portion positioned on one side of the second fixed portion, and a second holding portion positioned on the other side of the second fixed portion. The first elastic portion biases the outer peripheral surface of the first holding portion towards the outer peripheral surface of the inner conductor of the other coaxial connector. The second elastic portion biasing the outer peripheral surface of the second holding portion towards the outer peripheral surface of the inner conductor of the other coaxial connector.

20 Claims, 8 Drawing Sheets

COAXIAL CONNECTOR

REFERENCE TO RELATED APPLICATIONS

The Present Disclosure claims priority to prior-filed Japanese Patent Application No. 2013-254323, entitled "Coaxial Connector," filed on 9 Dec. 2013 with the Japanese Patent Office. The content of the aforementioned Patent Application is incorporated in its entirety herein.

BACKGROUND OF THE PRESENT DISCLOSURE

The Present Disclosure relates, generally, to a coaxial connector.

As electronic devices become more compact, the demand for smaller coaxial connectors increases. These coaxial connectors function as a receptacle (referred to as a first coaxial connector below) and as a plug (referred to as a second coaxial connector below). The first coaxial connector, which may be mounted on a circuit board, includes a tube-shaped first outer conductor and a first inner conductor arranged inside the first outer conductor. The second coaxial connector may be mounted on the end of a coaxial cable or on a circuit board. The second coaxial connector has a crimped portion secured to the coaxial cable, a second inner conductor electrically connected to the coaxial cable, and a tube-shaped second outer conductor surrounding the outside of the second inner conductor. In the first coaxial connector, the first outer conductor engages the inner peripheral surface of the second outer conductor of the second coaxial connector to mate the first inner conductor and the second inner conductor, and to establish an electrical connection with the second coaxial connector.

An example of this is disclosed in U.S. patent application Ser. No. 13/661,898, the content of which is hereby incorporated herein in its entirety. The '898 Application discloses a second coaxial connector which has a C-shaped second inner conductor with a slit. When the second outer conductor engages a first outer conductor, pressure is continuously applied to the outer peripheral surface of the first inner conductor and the inner peripheral surface of the second inner conductor.

SUMMARY OF THE PRESENT DISCLOSURE

As second coaxial connectors become more compact, there is a demand for smaller second inner conductors. However, this reduces the elasticity of second inner conductors, making it more difficult to maintain contact with the first inner conductor in a first coaxial connector. This causes a reduction in electrical conductivity between the first coaxial connector and the second coaxial connector.

In light of this situation, it is an object of the Present Disclosure to prevent any reduction in electrical conductivity between a first coaxial connector and a second coaxial connector. Accordingly, the Present Disclosure describes a coaxial connector comprising an outer conductor for engaging an outer conductor of another coaxial connector; an insulating portion arranged on the inside of the outer conductor; and an inner conductor arranged on the inside of the insulating portion and establishing contact with the outer peripheral surface of the inner conductor of the other coaxial connector. The insulating portion includes a first fixed portion having been fixed; a first elastic portion positioned on one end of the first fixed portion and moving elastically using the first fixed portion as a pivot; and a second elastic portion positioned on another end of the first fixed portion and moving elastically using the first fixed portion as a pivot. The inner conductor includes a second fixed portion having been fixed; a first holding portion positioned on one side of the second fixed portion; and a second holding portion positioned on another side of the second fixed portion. The first elastic portion biases the outer peripheral surface of the first holding portion towards the outer peripheral surface of the inner conductor of the other coaxial connector, and the second elastic portion biasing the outer peripheral surface of the second holding portion towards the outer peripheral surface of the inner conductor of the other coaxial connector.

The Present Disclosure may be a coaxial conductor wherein an end portion of the first elastic portion and an end portion of the second elastic portion are separated by a first slit. An end portion of the first holding portion and an end portion of the second holding portion are separated by a second slit. The first elastic portion and the first holding portion are fixed. The second elastic portion and the second holding portion are fixed. The Present Disclosure may be a coaxial conductor wherein the insulating portion has an arcuate plan view profile connecting the first elastic portion and the second elastic portion, and has a C-shaped plan view profile connecting the first elastic portion, the first fixed portion, and the second elastic portion; and the inner conductor has an arcuate plan view profile connecting the first holding portion and the second holding portion, and has a C-shaped plan view profile connecting the first holding portion, the second fixed portion, and the second holding portion.

The Present Disclosure may be a coaxial connector wherein the first slit and the second slit are positioned in the same direction from the first fixed portion. The Present Disclosure may be a coaxial connector wherein an opening in the first slit is larger than an opening in the second slit. The Present Disclosure may be a coaxial connector wherein a portion of the outer peripheral surface of the elastic portions engages a portion of the inner peripheral surface of the outer conductor.

The elastic force of the first elastic portion and the second elastic portion of the Present Disclosure can act on the inner conductor of the other coaxial connector unlike a coaxial connector lacking this configuration. This forcibly maintains contact between the coaxial connectors, and prevents any reduction in the electrical connection.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
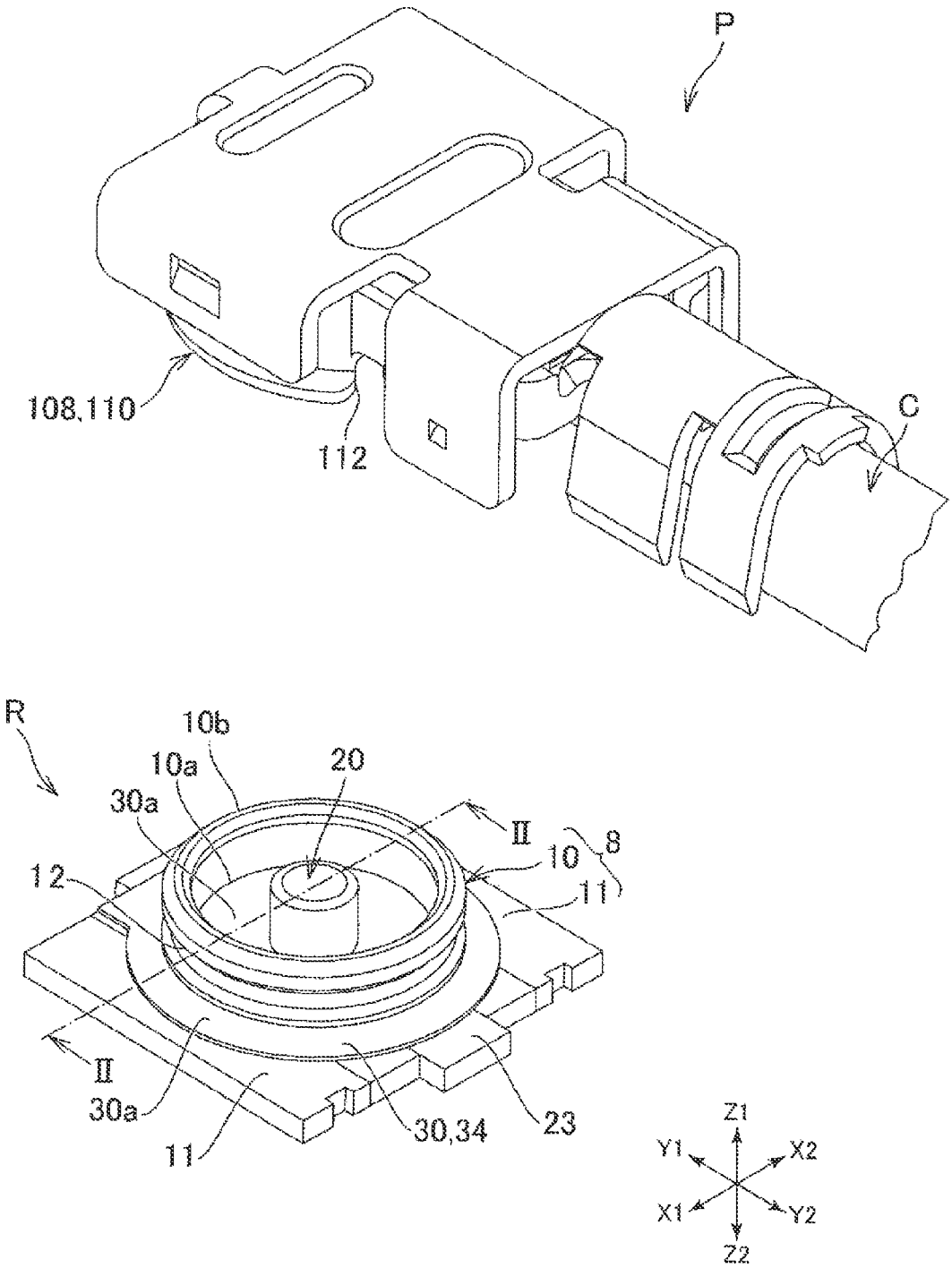
FIG. 1 is a perspective view of a first coaxial connector and a second coaxial connector in accordance with a first embodiment of the Present Disclosure.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Further, the Present Disclosure is an explanation of the configuration of the coaxial connectors (first coaxial connector, second coaxial connector) in an embodiment, with reference to the Figures. In the Figures, portions may have been enlarged for the sake of convenience in order to more easily explain the characteristics of the Present Disclosure, and the dimensional ratios between elements depicted in the drawings may not be the same as those of the actual elements. The materials mentioned in the following explanation are mere examples, and may be different from those of actual elements. Many modifications are possible without departing from the spirit and scope of the Present Disclosure.

Figure 2A:
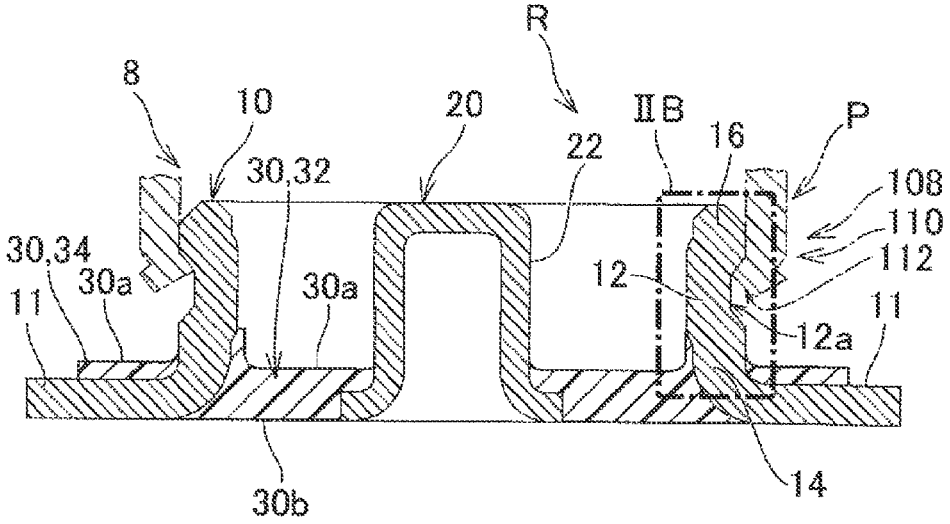
FIG. 2A is a cross-sectional view of the first coaxial connector of FIG. 1, from Line II-II.
Figure 2B:
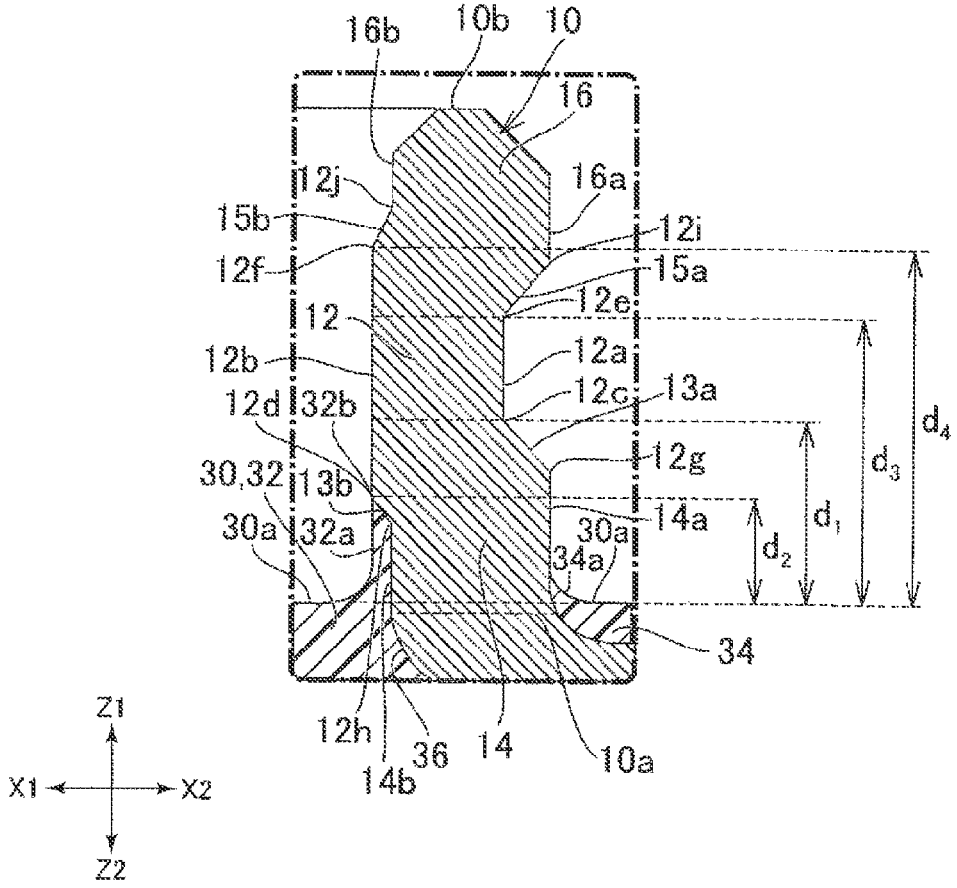
FIG. 2B is a partial enlarged view of the Area IIB of FIG. 2A.

FIG. 1 is a perspective view of the first coaxial connector R and the second coaxial connector P in a first embodiment of the Present Disclosure. The second coaxial connector P in FIG. 1 is fixed to a coaxial cable C. FIG. 2A is a cross-sectional view of the first coaxial connector R from Line II-II in FIG. 1. FIG. 2B is a partial enlarged view of Area IIB in FIG. 2A. For explanatory purposes, FIG. 2A shows the second coaxial connector P (the tube-shaped conductor 110 of the outer conductor 108) making contact with the first coaxial connector R.

In the Figures, the direction in which each coaxial cable C extends is Y (Y1, Y2). The leading end of the coaxial cable C faces direction Y1, and the opposite end faces direction Y2. In plan view, the direction orthogonal to direction Y (Y1, Y2) is direction X (X1, X2). The mating direction of the first coaxial connector R and the second coaxial conductor P is Z (Z1, Z2). The direction in which the second coaxial connector P is positioned when viewed from the first coaxial connector R is direction Z1, and the opposite direction is direction Z2.

The first coaxial connector R is the coaxial connector functioning as the receptacle, and is mated with the second coaxial connector P (plug). As shown in FIGS. 1 and 2A, the first coaxial connector R has an outer conductor 8, an inner conductor 20, and a panel-shaped insulator 30. The second coaxial connector P has an outer conductor 108 connected to outer conductor 8. An engaging portion 112 is provided on the inner periphery of the tube-shaped conductor 110 of the outer conductor 108. The configuration of the second coaxial connector P will be explained later.

The outer conductor 8 is connected to the outer conductor 108 of the second coaxial connector P and to a circuit board (not shown). As shown in FIGS. 1 and 2A, the outer conductor 8 has a tube-shaped portion 10 and a panel-shaped portion 11. The panel-shaped portion 11 is a wide portion extending in Direction X (X1, X2). The tube-shaped portion 10 is curved so as to extend a portion of the panel-shaped portion 11 in Direction Z1.

The tube-shaped portion 10 connects to the outer conductor 108 of the second coaxial connector P. The tube-shaped portion 10 is a tube-shaped electrode, and is coaxial with the inner conductor 20 and separate from the outer peripheral surface 22 of the inner conductor 20 in the plan view. The panel-shaped portion 11 surrounding the tube-shaped portion 10 is covered by the insulator 30 so that the tube-shaped portion 10 is held by the insulator 30.

In the present embodiment, the tube-shaped portion of the outer conductor 8 extending in Direction Z1 is the tube-shaped portion 10. The end portion of the tube-shaped portion 10 in Direction Z2 (at the boundary between the tube-shaped portion 10 and the panel-shaped portion 11 where the curve towards the panel-shaped portion 11 begins) is referred to as the one end portion 10*a*, and the end in direction Z1 is referred to as the other end portion 10*b*. Here, the panel-shaped portion 11 is held by the insulator 30, and the one end portion 10*a* of the tube-shaped portion 10 is fixed to the insulator 30.

An engaging portion 12 is formed in the tube-shaped portion 10. The engaging portion 12 engages the outer conductor 108 of the second coaxial connector P. As shown in FIG. 2A, the outer peripheral surface 12*a* is recessed on the inner conductor 20 side. In this configuration, the outer peripheral surface 12*a* of the engaging portion 12 engages the engaging portion 112 provided on the inner periphery of the tube-shaped conductor 110 of the outer conductor 108.

In other words, the tube-shaped conductor 110 of the outer conductor 108 of the second coaxial connector P is mated on the outer peripheral surface side of the tube-shaped portion 10 of the first coaxial connector R. In this way, the engaging portion 112 of the second coaxial connector P catches the engaging portion 12 (the recessed portion on the inner conductor 20 side) of the tube-shaped portion 10. As a result, the tube-shaped conductor 110 of the second coaxial connector P is kept from separating from the tube-shaped portion 10 of the first coaxial connector R.

The engaging portion 12 is preferably continuous so that it goes around the outer periphery of the tube-shaped portion 10 in the plan view. The engaging portion 12 may also have a split groove-shaped configuration. The configuration of the engaging portion 12 will be explained in greater detail later.

The panel-shaped portion 11 is connected to a connecting pad on the circuit board (not shown) and is integrated with the tube-shaped portion 10. The panel-shaped portion 11 has a panel-shaped configuration, and is soldered to the connecting pad in Direction Z2. In this way, the outer conductor 8 is connected electrically to a circuit board.

The inner conductor 20 is electrically connected to the inner conductor 120 of the second coaxial connector P described below. The inner conductor 20 is also provided inside the tube-shaped portion 10 in the plan view.

The insulator 30 is an insulating component used to electrically insulate the tube-shaped portion 10 from the inner conductor 20. The tube-shaped portion 10 and the inner conductor 20 protrude from the upper surface 30*a* of the insulator 30 in Direction Z1. The insulator 30 is provided inside the tube-shaped portion 10 and extends to the outside of the tube-shaped portion 10 in the plan view. The insulator 30 positioned inside the tube-shaped portion 10 is referred to as the inner insulator 32, and the insulator positioned to the outside of the tube-shaped portion 10 is referred to as the outer insulator 34. The inner insulator 32 of the insulator 30 has an inner wall 32*a* rising in a curved way from the upper surface 30*a* of the insulator 30 towards the first inner peripheral surface boundary portion 12*d*, described later. The outer insulator 34 of the insulator has an outer wall 34*a* rising in a curved way from the upper surface 30*a* of the insulator 30 towards the outer peripheral surface 14*a* of the first portion 14, described later.

Also, as shown in FIG. 1, a first terminal portion 23 protrudes from one end of the insulator 30 (the outer insulator 34) (in Direction Y2 of the present embodiment). The first terminal portion 23 is a terminal integrally formed with the inner conductor 20, and is mounted on a connecting pad of the circuit board (not shown) and soldered on the surface facing Direction Z2.

The following is a detailed description of the tube-shaped portion 10. As shown in FIG. 2B, the tube-shaped portion 10 has an engaging portion 12 which is a recessed part on the inner conductor 20 side, a first portion 14 positioned closer than the engaging portion 12 to the one end portion 10*a* of the tube-shaped portion 10 (in Direction Z2 of the Figure), and a second portion 16 positioned closer than the engaging portion 12 to the other end portion 10*b* of the tube-shaped portion 10 (in Direction Z1).

In the present embodiment, the engaging portion 12 on the outer peripheral surface of the tube-shaped portion 10 corresponds to the recessed position on the inner conductor 20. The first portion 14 extends from the engaging portion 12 in Direction Z2, and the second portion 16 extends from the engaging portion 12 in Direction Z1.

In this configuration, the outer peripheral surface 12*a* of the engaging portion 12 is positioned closer to the inner conductor 20 side (Direction X1 in FIG. 2B) than the outer peripheral surface 14*a* of the first portion 14 and the outer peripheral surface 16*a* of the second portion 16. The end 12*c* of the outer peripheral surface 12*a* of the engaging portion 12 in Direction Z2 is connected to the outer peripheral surface 14*a* of the first portion 14 via a first outer peripheral surface inclined portion 13*a*, and the end 12*e* of the outer peripheral surface 12*a* in Direction Z1 is connected to the outer peripheral surface 16*a* of the second portion 16 via a second outer peripheral surface inclined portion 15*a*. The first outer peripheral surface inclined portion 13*a* is a surface inclined towards the outer peripheral surface 14*a* of the first portion 14, and the second outer peripheral surface inclined portion 15*a* is a surface inclined towards the outer peripheral surface 16*a* of the second portion 16.

Also, as shown in FIG. 2B, the inner peripheral surface 12*b* of the engaging portion 12 is preferably positioned closer to the inner conductor 20 than both the inner peripheral surface 14*b* of the first portion 14 and the inner peripheral surface 16*b* of the second portion 16. In this configuration, the first coaxial connector R has a smaller difference in thickness of the engaging portion 12, the first portion 14, and the second portion 16 than a coaxial connector without this configuration. This can keep the thickness of the engaging portion 12 from becoming thin, and improve the strength of the engaging portion 12 without increasing the overall thickness of the tube-shaped portion 10. In this way, the strength of the engaging portion 12 can be maintained even though the first coaxial connector R is smaller. It can also improve the strength of the smaller first coaxial connector R.

In this configuration, the end 12*d* of the inner peripheral surface 12*b* of the engaging portion 12 in Direction Z2 is connected to the inner peripheral surface 14*b* of the first portion 14 via the first inner peripheral surface inclined portion 13*b*, and the end 12*f* (the third inner peripheral surface boundary portion) of the inner peripheral surface 12*b* in Direction Z1 is connected to the inner peripheral surface 16*b* of the second portion 16 via the second inner peripheral surface inclined portion 15*b*. The first inner peripheral surface inclined portion 13*b* is a surface inclined towards the inner peripheral surface 14*b* of the first portion 14, and the second inner peripheral surface inclined portion 15*b* is a surface inclined towards the inner peripheral surface 16*b* of the second portion 16.

In the present embodiment, the inner peripheral surface 12*b* is positioned closer to the inner conductor 20 than the inner peripheral surface 14*b* of the first portion 14 and the inner peripheral surface 16*b* of the second portion 16. However, the inner peripheral surface 12*b* may also be positioned closer to the inner conductor 20 than either the inner peripheral surface 14*b* of the first portion 14 or the inner peripheral surface 16*b* of the second portion 16.

In the first coaxial connector R of the present embodiment, the inner peripheral surface 12*b* of the tube-shaped portion 10 is positioned closer to the inner conductor 20 than either the inner peripheral surface 14*b* of the first portion 14 or the inner peripheral surface 16*b* of the second portion 16. The position of the first inner peripheral surface inclined portion 13*b* is also shifted towards the one end portion 10*a* of the tube-shaped portion 10 (in Direction Z2) relative to the position of the first outer peripheral surface inclined portion 13*a*. This reduces the difference in thickness of any one of the engaging portion 12, the first portion 14 and the second portion 16 compared to a coaxial connector without the configuration.

This can keep the thickness of the engaging portion 12 from becoming thin, and improve the strength of the engaging portion 12 without increasing the overall thickness of the tube-shaped portion 10. In this way, the strength of the engaging portion 12 can be maintained even though the first coaxial connector R is smaller. It can also improve the strength of the smaller first coaxial connector R. Also, the distance d1 from the upper surface 30*a* of the insulator 30 to the end 12*c* (the first outer peripheral surface boundary portion) at the boundary between the first outer peripheral surface inclined portion 13*a* and the outer peripheral portion 12*a* of the engaging portion 12 is preferably greater than the distance d2 from the upper surface 30*a* of the insulator 30 to the end 12*d* (the second inner peripheral surface boundary portion) at the boundary between the first inner peripheral surface inclined portion 13*b* and the inner peripheral portion 12*b* of the engaging portion 12.

In this configuration, unlike a coaxial connector without this configuration, the distance between the first outer peripheral surface inclined portion 13*a* and the inner peripheral surface 12*b* (the thickness of the area of the tube-shaped portion 10 corresponding to the first outer peripheral surface inclined portion 13*a*) is maintained. As a result, a reduction in the strength of the portion corresponding to the first outer peripheral surface inclined portion 13*a* is prevented.

Also, in this configuration, stress is applied to the tube-shaped portion 10 at different heights with respect to the outer peripheral surface (the first outer peripheral surface boundary portion 12*c*) and the inner peripheral surface (the first inner peripheral surface boundary portion 12*d*) of the tube-shaped portion 10. As a result, the stress applied to the first coaxial connector R is easily distributed compared to a first coaxial connector R without this configuration.

In this way, the tube-shaped portion 10 is less likely to be deformed by the application of stress, and the strength of the tube-shaped portion 10 is improved. Moreover, as mentioned above, the strength of the engaging portion 12 can be maintained even though the first coaxial connector R is smaller. It can also improve the strength of the smaller first coaxial connector R.

The distance d1 from the upper surface 30*a* of the insulator 30 to the first outer peripheral surface boundary portion 12*c* is preferably greater than the distance from the upper surface 30*a* to the first inner peripheral surface boundary portion 12*h* at the boundary between the first inner peripheral surface inclined portion 13*b* and the inner peripheral surface 14*b* of the first portion 14. Also, the distance from the upper surface 30*a* to the third outer peripheral surface boundary portion 12*g* at the boundary between the first outer peripheral surface inclined portion 13*a* and the outer peripheral surface 14*a* of the first portion 14 is preferably greater than the distance from the upper surface 30*a* to the first inner peripheral surface boundary portion 12*h*. Also, the distance from the upper surface 30*a* to the third outer peripheral surface boundary portion 12*g* is preferably greater than the distance d2 from the upper surface 30*a* to the second inner peripheral surface boundary portion 12*d*.

In the configuration of the first coaxial connector R of the present embodiment, unlike a coaxial connector R without this configuration, the thickness of the tube-shaped portion 10 corresponding to the second inner peripheral surface boundary portion 12*d* is increased as shown in FIG. 2B. This can prevent deformation of the tube-shaped portion 10 when stress is applied. Also, the distance d3 from the upper surface 30*a* of the insulator 30 to the end 12*e* (the second outer peripheral surface boundary portion) at the boundary between the second outer peripheral surface inclined portion 15*a* and the outer peripheral surface 12*a* of the engaging portion 12 is preferably smaller than the distance d4 from the upper surface 30*a* of the insulator 30 to the end 12*f* (the third inner peripheral surface boundary portion) at the boundary between the second inner peripheral surface inclined portion 15*b* and the inner peripheral surface 12*b* of the engaging portion 12.

In the configuration of the first coaxial connector R of the present embodiment, stress is applied to the tube-shaped portion 10 at more locations than in a coaxial connector without this configuration. As a result, the stress applied to the tube-shaped portion 10 is more readily dispersed, and the strength of the tube-shaped portion 10 is improved. Also, the distance d3 from the upper surface 30*a* of the insulator 30 is preferably smaller than the distance from the upper surface 30*a* to the fourth inner peripheral surface boundary portion 12*j* at the boundary between the second inner peripheral surface inclined portion 15*b* and the inner peripheral surface 16*b* of the second portion 16, and the distance from the upper surface 30*a* to the fourth outer peripheral surface boundary portion 12*i* at the boundary between the second outer peripheral surface inclined portion 15*a* and the outer peripheral surface 16*a* of the second portion 16 is preferably smaller than the distance to the fourth inner peripheral surface boundary portion 12*j*. Also, the distance from the upper surface 30*a* to the fourth outer peripheral surface boundary portion 12*i* is preferably smaller than the distance from the upper surface 30*a* to the third inner peripheral surface boundary portion 12*f*.

In the configuration of the first coaxial connector R of the present embodiment, unlike a coaxial connector R without this configuration, the thickness of the tube-shaped portion 10 corresponding to the third inner peripheral surface boundary portion 12*f* is increased. This can prevent deformation of the tube-shaped portion 10 when stress is applied.

In a tube-shaped portion 10 with this configuration, stress is applied to the tube-shaped portion 10 at locations (first outer surface boundary portion 12*c*, first inner peripheral surface boundary portion 12*h*, second outer surface boundary portion 12*e*, second inner peripheral surface boundary portion 12*d*, third outer surface boundary portion 12*g*, third inner peripheral surface boundary portion 12*f*, fourth outer surface boundary portion 12*i*, and fourth inner peripheral surface boundary portion 12*j*) which are at different distances from the upper surface 30*a* of the insulator 30. This can prevent deformation of the tube-shaped portion 10 by the application of stress, and improve the strength of the tube-shaped portion 10. Also, as shown in FIG. 2B, when viewed from the side with the second coaxial connector P (the Y direction), the length of the first outer peripheral surface inclined portion 13*a* from the first outer peripheral surface boundary portion 12*c* to the third outer peripheral surface boundary portion 12*g* (the length from the first outer peripheral surface boundary portion 12*c* to the third outer peripheral surface boundary portion 12*g*) is preferably greater than the length of the first inner peripheral surface inclined portion 13*b* from the second inner peripheral surface boundary portion 12*d* to the first inner peripheral surface boundary portion 12*h* (the distance from the second inner peripheral surface boundary portion 12*d* to the first inner peripheral surface boundary portion 12*h*).

In this configuration, the interval between the engaging portion 12 and the inner conductor 20 of the first coaxial connector R is smaller than that of a coaxial connector without this configuration, but the area coming into contact with the engaging portion 112 of the second coaxial connector P is maintained. Also, while the first coaxial connector R and the second coaxial connector P remain reliably engaged, the locations at which the tube-shaped portion 10 is subjected to stress can be spread out over a greater distance from the upper surface 30*a* of the insulator 30. As a result, the strength of the tube-shaped portion 10 can be improved and a reduction in electrical contact prevented without increasing the overall thickness of the tube-shaped portion 10.

Also, as shown in FIG. 2B, the first inner peripheral surface boundary portion 12*h* is preferably positioned closer to the lower surface 30*b* (in Direction Z2) of the insulator 30 than the boundary 32*b* between the inner insulator 32 and the tube-shaped portion 10. The bend (first inner peripheral surface boundary portion 12*h*) at the boundary 36 between the panel-shaped portion 11 and the inner insulator 32 is covered in this configuration by the inner wall 32*a* of the insulator 30.

In the configuration of the first coaxial connector R of the present embodiment, when the surface of the panel-shaped portion 11 of the first coaxial connector R is soldered to the circuit board (not shown), even if some of the molten solder reaches boundary 36 between the panel-shaped portion 11 and the inner insulator 32 on the upper surface 30*a* (Direction Z1) side, it collects in the first inner peripheral surface boundary portion 12*h* at the bend in the boundary 36. As a result, the molten solder does not reach the upper surface 30*a* side. This can prevent connection defects between the first coaxial connector R and the circuit board, and short-circuiting of the outer conductor 8 and the inner conductor 20.

Also, the engaging portion 12 is preferably formed using bead processing. More specifically, a column-shaped first stamp containing a groove-like recessed portion is arranged on the inside of a metal sheet formed into a tube shape (the tube-shaped portion 10), and a tube-shaped second stamp containing a ridge-like protruding portion is arranged to the outside of the tube-shaped portion 10, and pressure is applied in the direction of this first stamp. Because an area is provided which corresponds to the recessed portion and the protruding portion, when the tube-shaped portion 10 is pressed into the first stamp by the second stamp, the portion interposed between the protruding portion and the recessed portion is deformed to form an engaging portion 12. When the engaging portion 12 is formed using bead processing, the first coaxial connector R in the present embodiment is stronger than a coaxial connector without this configuration. It should be noted that the engaging portion 12 does not have to be formed using bead processing. It may be formed using another method. For example, the tube-shaped portion 10 may be a metal sheet with a ridge-like protrusion wrapped into the shape of a tube.

In the first coaxial connector R of the present embodiment, the engaging portion 12 is formed continuously so as to surround the outer periphery of the tube-shaped portion 10 in the plan view. As a result, the length occupied by the engaging portion 12 is longer than that of a coaxial connector without this configuration. As a result, the strength of the tube-shaped portion 10 can be increased and any reduction in electrical connectivity prevented.

Figure 3:
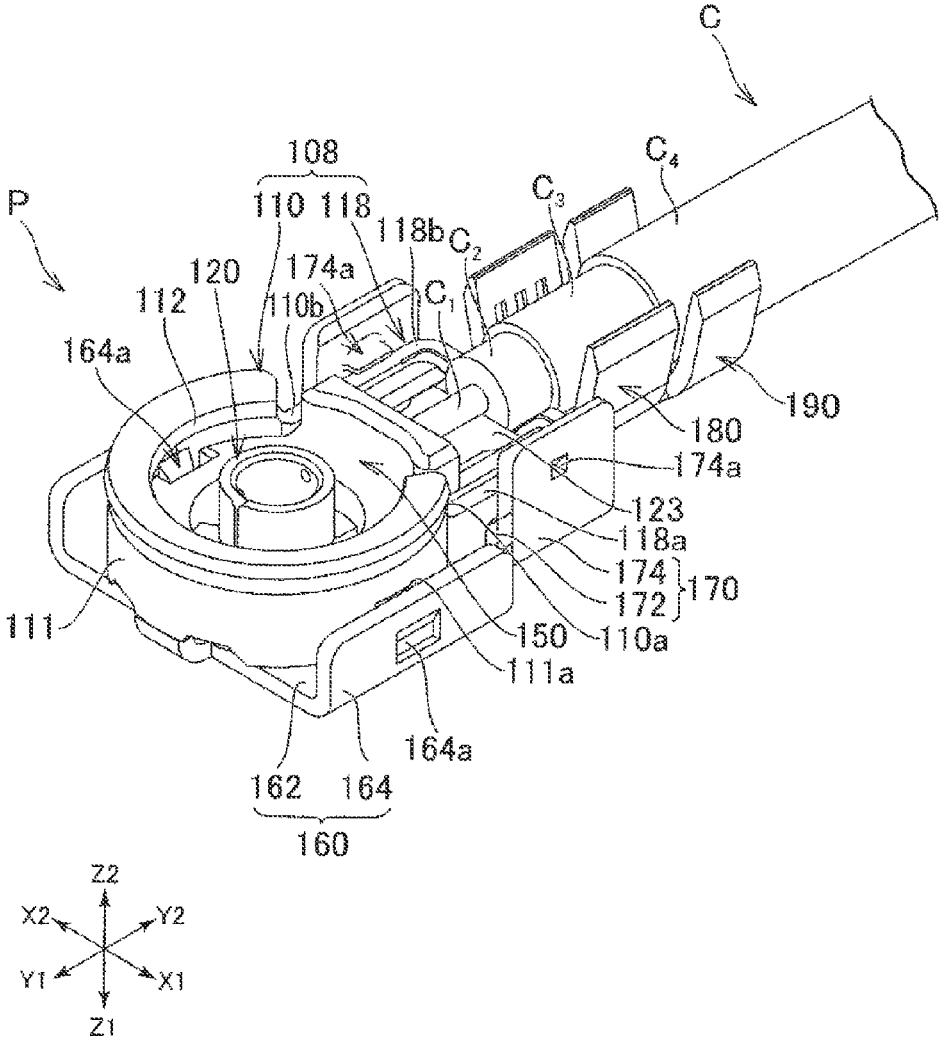
FIG. 3 is a perspective view of the second coaxial connector of FIG. 1.

FIGS. 3-6 refer to the the configuration of the second coaxial connector P. In FIG. 3, the second coaxial connector P is fixed to the leading end of a coaxial cable C. The coaxial cable C has an inner conductive wire C1 made of metal surrounded by an insulator C2 made of an insulating material. The insulator C2 is covered by an outer conductive wire C3, and the outer conductive wire C3 is covered by a protective layer C4 made of an insulating material. In the end portion of the coaxial cable C on the second coaxial connector P end (Direction Y1 in FIG. 3), a portion of the insulator C2, outer conductive wire C3 and protective layer C4 are removed to expose a portion of the inner conductive wire C1 and the outer conductive wire C3.

Figure 4:
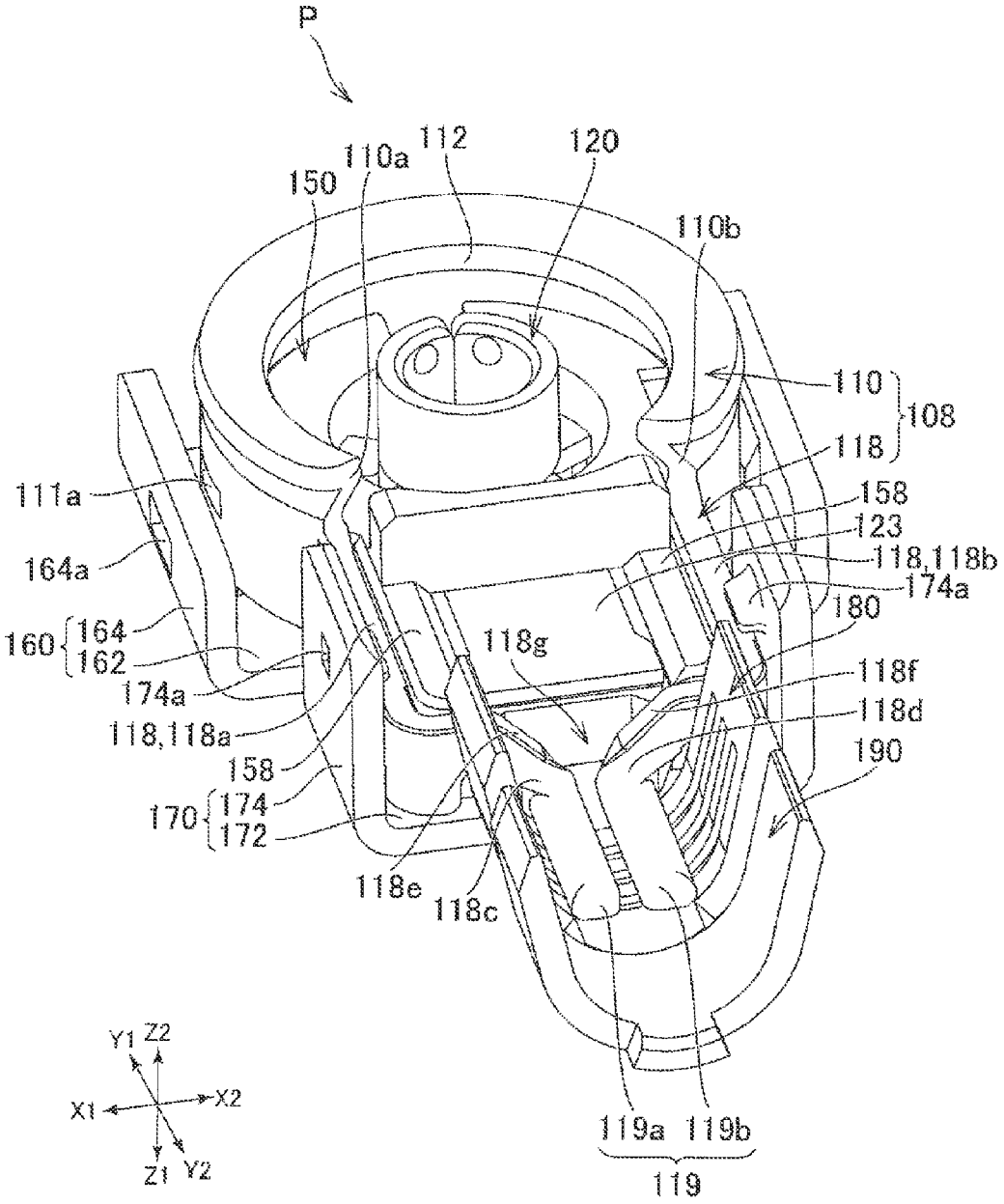
FIG. 4 is a perspective view of the second coaxial connector of FIG. 3.

The second coaxial connector P is the coaxial connector functioning as the plug, and is mated with the first coaxial connector R described earlier. As shown in FIG. 3, the second coaxial connector P is the connector connected to the coaxial cable C. Further, as shown in FIGS. 3-4, the second coaxial connector P has an outer conductor 108, an insulating portion 150, and an inner conductor 120.

The outer conductor 108 is connected electrically to the outer conductor 8 of the other coaxial connector (the first coaxial connector R) in FIG. 1. As shown in FIGS. 3-4, the outer conductor 108 has a tube-shaped conductor 110, arm portions 118, a first cover portion 160, a second cover portion 170, a third cover portion 180, and a fourth cover portion 190. The tube-shaped conductor 110 is a conductor formed in the shape of a tube, and is arranged so as to be concentric with the inner conductor 120 in the plan view.

The tube-shaped conductor 110 engages and is electrically connected to the tube-shaped portion 10 of the first coaxial connector R. An engaging portion 112 is formed in the inner peripheral surface of the tube-shaped conductor 110. The engaging portion 112 is configured to engage the engaging portion 12 of the first coaxial connector R, and has a configuration which protrudes towards the inner conductor 120. In this configuration, the engaging portion 112 catches the outer periphery of the engaging portion 12 of the first coaxial connector R. In this way, it is kept from separating from the tube-shaped portion 10 of the first coaxial connector R.

The two arm portions 118*a*, 118*b* are integrally formed with the tube-shaped conductor 110 to form a C-shaped profile in the plan view. The two arm portions 118*a*, 118*b* extend from the end portions 110*a*, 110*b* of the tube-shaped conductor 110 (end portions of the C-shaped profile) towards the coaxial cable C (on the Y2 side). As shown in FIG. 4, the ends of the arm portions 118*a*, 118*b* in Direction Y2 preferably include guide portions 118*c*, 118*d*. The ends of the guide portions 118*c*, 118*d* in Direction Y2 preferably include two extending portions 119*a*, 119*b* extending outward from the tube-shaped portion 10 (in Direction Y2 in FIG. 4).

The guide portions 118*c*, 118*d* guide the insulator C2 in order to position the inner conductive wire C1 of the coaxial cable C. As shown in FIG. 4, the guide portions 118*c*, 118*d* are formed so as to extend from the ends of the arm portions 118*a*, 119*b* in direction Y2 towards the extending portions 119 on an incline in Direction Z1. In other words, the guide portions 118*c*, 118*d* are inclined in Direction Z1 towards each other so as to establish contact with the outer periphery of the insulator C2. Because the guide portions 118*c*, 118*d* have this configuration, a recessed portion 118*g* is formed which has inclined surfaces 118*e*, 118*f* inclined in Direction Z1. In other words, guide portion 118*c* and guide portion 118*d* are combined to form a recessed portion 118*g*. In this configuration, the coaxial cable C is mounted in the second coaxial connector P, and the outer periphery of the insulator C2 of the coaxial cable C makes contact with the inclined surfaces 118*e*, 118*f* of the recessed portion 118*g*. In this way, the insulator C2 of the coaxial cable C can be easily guided into the predetermined position. Therefore, the inner conductive wire C1 of the coaxial cable C can be easily and correctly positioned with respect to the second terminal portion 123 described later. The ends of the guide portions 118*c*, 118*d* in direction Y2 remain substantially parallel to each other while extending in Direction Y2 because of the two extending portion 119*a*, 119*b*. In the Present Disclosure, "substantially parallel" does not mean perfectly parallel but parallel within the manufacturing tolerance.

In the configuration of the second coaxial connector P in the present embodiment, the outer conductive wire C3 of the coaxial cable C is mounted on the extending portions 119, and the very bottom of the outer conductive wire C3 (towards Direction Z2 in FIG. 4) is mounted between extending portion 119*a* and extending portion 119*b*. As a result, the coaxial cable C can be positioned more accurately than a coaxial cable without this configuration. Because the two extending portions 119 are formed so that the ends of the guide portions 118*c*, 118*d* of the outer conductor 108 extend in Direction Y2, a separate positioning component is not required to position the coaxial cable C. The extending portions 119 are preferably made of metal, but may be made of any material that is not adversely affected by heat in the manufacturing process. Also, the distance between extending portion 119*a* and extending portion 119*b* may be adjusted to the diameter of the outer conductive wire C3 of the coaxial cable C.

The first cover portion 160, the second cover portion 170, the third cover portion 180 and the fourth cover portion 190 are integrally formed with the tube-shaped conductor 110 and establish an electrical connection with each other. The first cover portion 160 covers the surface opposite the mating surface of the tube-shaped conductor 110 (the Surface Facing Direction Z2). The first cover portion 160 includes a first mounting portion 162 on which the tube-shaped conductor 110, insulating portion 150 and inner conductor 120 are mounted, and a first side portion 164 engaging a portion of the outer periphery 111 of the tube-shaped conductor 110.

As shown in FIGS. 3-4, a protruding portion 164*a* is preferably provided on the inner periphery (the inner conductor 120 side) of the first side portion 164. The protruding portion 164*a* protrudes towards the inner conductor 120 and is provided to secure the tube-shaped conductor 110 to the first cover portion 160. More specifically, the protruding portion 164*a* engages the first recessed portion 111*a* provided on the outer periphery 111 of the tube-shaped conductor 110 to secure the tube-shaped conductor 110 to the first cover portion 160. The protruding portion 164*a* provided on the first cover portion 160 of the second coaxial connector P in the present embodiment more reliably secures the tube-shaped conductor 110 to the first cover portion 160 than in a coaxial connector without the present configuration.

In the tube-shaped conductor 110 in the present embodiment, the inner peripheral surface of the engaging portion 112 engages the outer peripheral surface of the engaging portion 12 provided in the tube-shaped portion 10 of the first coaxial connector R. This applies stress which opens the tube-shaped conductor 110 to the outside. In this way, the protruding portion 164*a* engages the recessed portion 111*a* even when the tube-shaped conductor 110 is biased towards the first side portion 164 of the first cover portion 160, and the stress which opens the tube-shaped conductor 110 outwards also acts on the first side portion 164. In this way, the stress on the first side portion 164 can increase the stress opening the tube-shaped conductor 110 to the outside, which prevents excessive deformation of the tube-shaped conductor 110, and keeps the tube-shaped conductor 110 from detaching from the first cover portion 160.

The second cover portion 170 is secured by the arm portions 118. The second cover portion 170 has a second mounting portion 172 on which the arm portions 118 are mounted, and a second side portion 174 engaging the arm portions 118. The inner peripheral surface side (arm portion 118 side) of the second side portion 174 of the second cover portion 170 is preferably secured to the arm portions 118. More specifically, as shown in FIGS. 3-4, providing the protruding portion 174*a* on the inner peripheral surface of the inner peripheral surface of the second side portion 174 of the second cover portion 170 enables the protruding portion 174*a* to engage the upper surfaces of the arm portions 118*a*, 118*b*.

The configuration of the second coaxial connector P in the present embodiment enables the arm portions 118 of the outer conductor 108 to be more reliably secured to the second cover portion 170 than in a coaxial connector without the present configuration. When the protruding portion 174*a* provided on the inner peripheral surface of the second side portion 174 of the second cover portion 170 engages the upper surfaces of the arm portions 118*a*, 118*b*, the stress opening the tube-shaped conductor 110 to the outside can be transmitted to the arm portions 118*a*, 118*b*, keeping the arm portions 118 from rising off of the second mounting portion 172 and detaching from the second cover portion 170. When the arm portions 118 are fixed to the second cover portion 170 in this way, the extending portions 119*a*, 119*b* shown in FIG. 4 can be prevented from shifting position. As a result, the extending portions 119*a*, 119*b* are able to correctly align the coaxial cable C.

The third cover portion 180 secures the outer conductive wire C3 of the coaxial cable C, and the fourth cover portion 190 secures the protective layer C4 of the coaxial cable C. The third cover portion 180 shown in FIG. 3 is crimped to maintain contact pressure on the outer conductive wire C3, and to maintain an electrical connection with the outer conductive wire C3. The fourth cover portion 190 is also crimped to maintain contact pressure on the protective layer C4 and to secure the protective layer C4. The insulating portion 150 is a component made of an insulating material to electrically insulate the outer conductor 108 and the inner conductor 120, and is arranged on the inside of the tube-shaped conductor 110. The insulating portion 150 is made, for example, of a resin or a rubber and, as explained later, is configured so as to be elastically deformable. The configuration of the insulating portion 150 will be explained in greater detail below.

The inner conductor 120 is a conductor connected to the inner conductor 20 of the first coaxial connector R and is arranged inside the insulating portion 150 in the plan view. More specifically, the inner conductor 20 of the first coaxial connector R is fitted inside the inner conductor 120, to establish contact while maintaining contact pressure on the inner peripheral surface 122*b* of the inner conductor 120 and on the outer peripheral surface 22 of the inner conductor 20 of the first coaxial connector R. This establishes an electrical connection between the coaxial cable C, the second coaxial connector P, and the first coaxial connector R.

Figure 5:
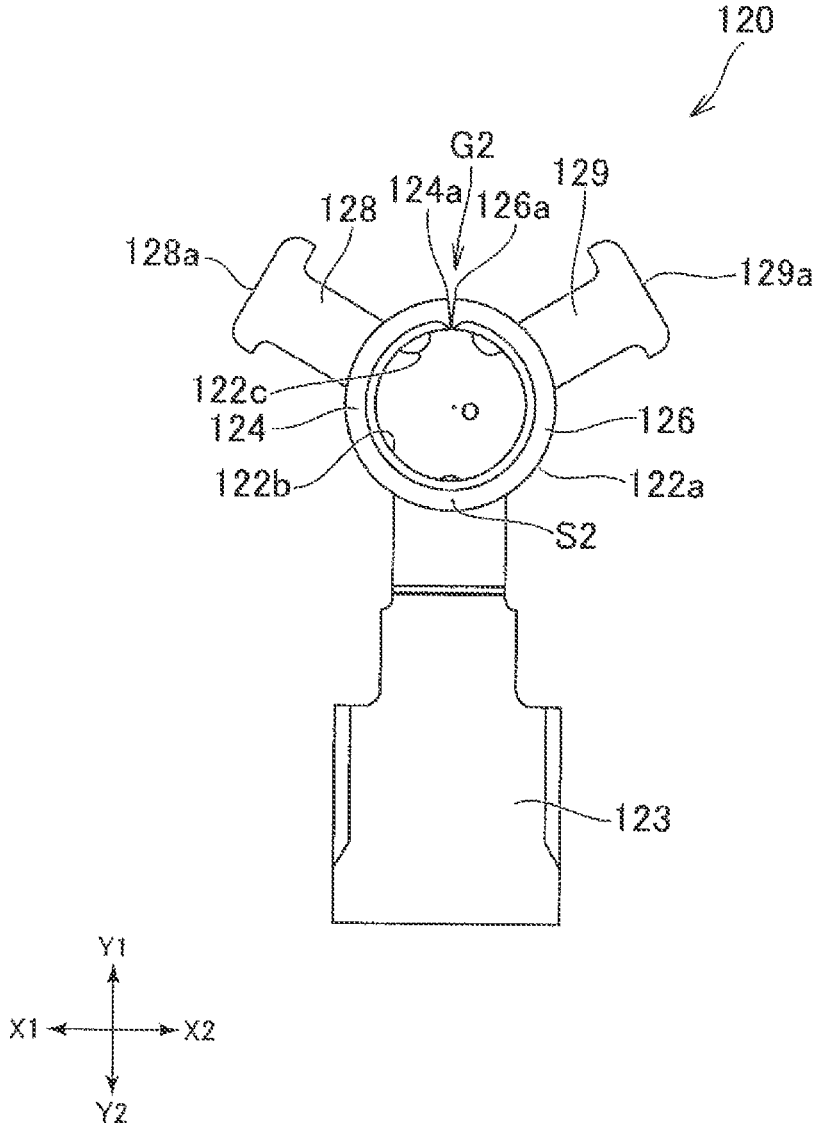
FIG. 5 is a plan view of the inner conductor of FIG. 3, from Direction Z2.

As shown in FIG. 5, the inner conductor 120 includes a second fixed portion S2 fixed to the end portion of the terminal portion 123 in Direction Y1, a first holding portion 124 positioned to one side (the X1 side) of the second fixed portion S2, and a second holding portion 126 positioned to the other side (the X2 side) of the second fixed portion S2. A second terminal portion 123 integrally formed with the inner conductor 120 is provided on the Y2 side of the inner conductor 120. The second terminal portion 123 is a terminal connected electrically to the inner conductive wire C1 of the coaxial cable C.

Figure 6:
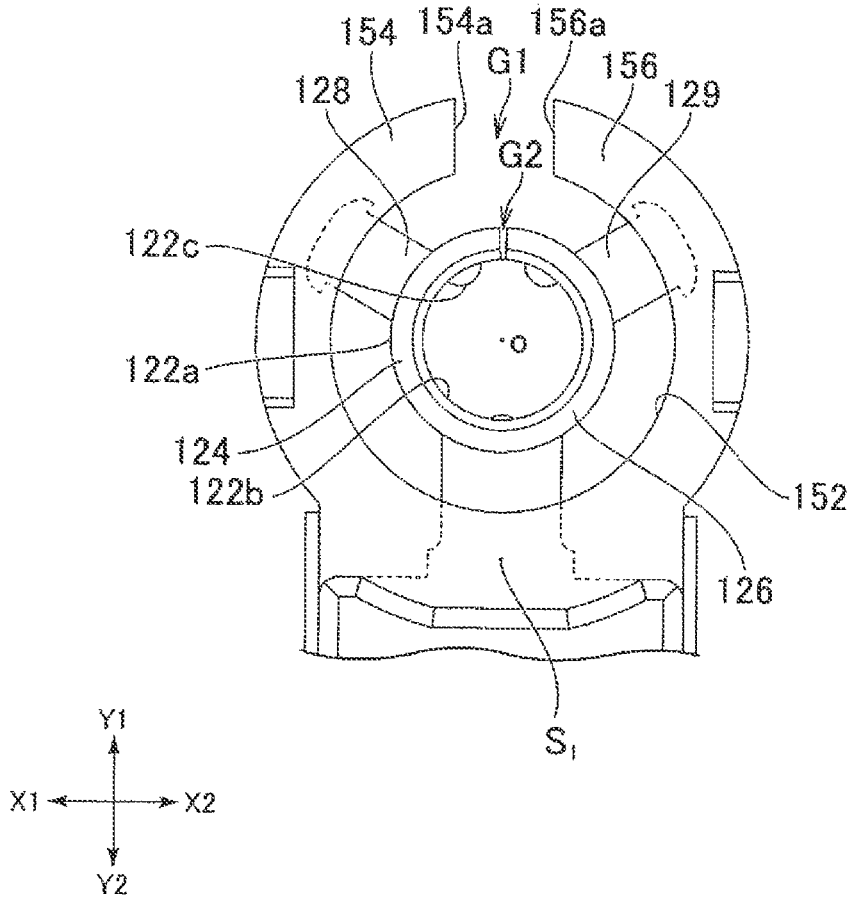
FIG. 6 is a plan view of the inner conductor and the outer conductor of the second coaxial connector in FIG. 3, from Direction Z2.

As shown in FIGS. 4 and 6, the insulating portion 150 has a holding portion 158 extending from the first fixing portion S1 in direction Y2, and secures the second terminal portion 123. The holding portion 158 and the second terminal portion 123 are fixed between the arm portions 118*a*, 118*b*. The first holding portion 124 and the second holding portion 126 maintain contact pressure on the inner conductor 20 of the first coaxial connector R described earlier. The second fixed portion S2 also acts as the fixed pivot point of the first holding portion 124 and the second holding portion 126.

The diameter of the inner conductor 20 of the first coaxial connector R is greater than the diameter of the area surrounding the inner peripheral surface 122*b* of the inner conductor 120. The inner conductor 20 of the first coaxial connector R is fitted inside the first holding portion 124 and the second holding portion 126, the first holding portion 124 and the second holding portion 126 push apart from the inner peripheral surface 122*b* side, and the inner peripheral surface 122*b* of the first holding portion 124 and the second holding portion 126 are biased by the outer peripheral surface 22 of the inner conductor 20 of the first coaxial connector R.

The end portion 124*a* of the first holding portion 124 in Direction Y1 and the end portion 126*a* of the second holding portion 126 in Direction Y1 are separated by a second slit G2. The second slit G2 is formed so as to extend radially from center point O in the area surrounded by the inner peripheral surface 122*b* of the inner conductor 120. In this configuration, the elastic force of the first holding portion 124 and the second holding portion 126 acts to close the second slit G2 with the second fixed portion S2 serving as the fixed pivot point.

FIG. 5 is a plan view of the inner conductor 120 from Direction Z2 (the mating direction of the inner conductor 20 of the first coaxial connector R). However, as shown in FIG.

5, the planar profile of both the first holding portion 124 and the second holding portion 126 is arcuate, and the second fixed portion S2 at the boundary between the first holding portion 124 and the second holding portion 126 is fixed in a single location. The planar profile connecting the first holding portion 124, the second fixed portion S2, and the second holding portion 126 is preferably C-shaped with the second slit G2 serving as the opening. Because the second coaxial connector P in the present embodiment has this configuration, the first holding portion 124 and the second holding portion 126 act to open and close the second slit G2 with the second fixed portion S2 serving as the pivot point.

When the inner conductor 20 of the first coaxial connector R is fitted inside the first holding portion 124 and the second holding portion 126, contact is established with contact pressure being applied to the inner conductor 20 of the first coaxial connector R and the inner conductor 120 of the second coaxial connector P, and an electrical connection is established. As shown in FIG. 5, a protruding portion 122*c* may be formed on the inner peripheral surface 122*b* of the inner conductor 120 which protrudes in the direction of the center point O. When a protruding portion 122*c* is formed on the inner peripheral surface 122*b*, contact pressure is maintained between the protruding portion 122*c* and the inner conductor 20 of the first coaxial connector R, and a stable electrical connection can be established between the inner conductor 120 and the inner conductor 20 of the first coaxial connector R.

A first connecting portion 128 and a second connecting portion 129 may be provided, respectively, on the outer peripheral surface 122*a* of the first holding portion 124 and the outer peripheral surface 122*a* of the second holding portion 126. The first connecting portion 128 and the second connecting portion 129 transmit the elastic force of the insulating portion 150 to the first holding portion 124 and the second holding portion 126. The first connecting portion 128 partially connects the first holding portion 124 and the insulating portion 150, and the second connecting portion 129 partially connects the second holding portion 126 and the insulating portion 150. There are no particular restrictions on this configuration. In the present embodiment, the inner conductor 120 and the insulating portion 150 are integrally molded to establish the connection. However, there are no particular restrictions on the method used to connect the inner conductor 120 and the insulating portion 150. For example, forcible insertion may be used.

In the present embodiment, as shown in FIG. 5, the first connecting portion 128 extends from the first holding portion 124 towards the insulating portion 150, and the second connecting portion 129 extends from the second holding portion 126 towards the insulating portion 150. The end portion 128*a* on the insulating portion 150 side of the first connecting portion 128, and the end portion 129*a* on the insulating portion 150 side of the second connecting portion 129 are each fixed to the insulating portion 150. Also as shown in FIG. 5, the first connecting portion 128 and the second connecting portion 129 are preferably provided on the second slit G2 side (Y1 direction side) of the center point O. More specifically, the angle formed by the first connecting portion 128, the center point O and the end portion 124*a*, and the angle formed by the second connecting portion 129, the center point O and the end portion 126*a* are smaller than the angle formed by the first connecting portion 128, the center point O and the second fixed portion S2, and the angle formed by the second connecting portion 129, the center point O and the second fixed portion S2.

In this configuration, unlike a configuration in which the first connecting portion 128 and the second connecting portion 129 are provided on the second fixed portion S2 side of the center point O, the elastic force from the insulating portion 150 is effectively transmitted to the first holding portion 124 and the second holding portion 126. In this way, the elastic force from the insulating portion 150 readily acts to close the second slit G2, and contact pressure is easily maintained on the inner conductor 120 and the inner conductor 20 of the first coaxial connector R. The first connecting portion 128 and the second connecting portion 129 are preferably formed on the Y1 side of the X axis in the X direction passing through the center point O surrounded by the inner peripheral surface 122*b* of the inner conductor 120. In this configuration, contact pressure is readily maintained on the inner conductor 120 and the inner conductor 20 of the first coaxial connector R.

The insulating portion 150 includes a first fixed portion S1 which has been fixed, a first elastic portion 154 positioned to one side of the first fixed portion S1 (on the X1 direction side) and acting elastically with the first fixed portion S1 acting as the pivot point, and a second elastic portion 156 positioned on the other side if the fixed portion S1 (on the X2 direction side) and acting elastically with the first fixed portion S1 acting as the pivot point. The first elastic portion 154 biases the outer peripheral surface 122*a* of the first holding portion 124 towards the outer peripheral surface 22 of the inner conductor 20 of the other coaxial connector (the first coaxial connector R) (on the center point O side to the inside of the inner conductor 120 in FIG. 6), and the second elastic portion 156 biases the outer peripheral surface 122*a* of the second holding portion 126 towards the outer peripheral surface 22 of the inner conductor 20 of the first coaxial connector R. Because of this configuration, the insulating portion 150 is elastically deformable and applies biasing force in the direction of the center point O. As a result, the first holding portion 124 and the second holding portion 126 are biased towards the center point O via the first connecting portion 128 and the second connecting portion 129 fixed to the insulating portion 150.

The first fixed portion S1 acts as a fixed pivot point for the first elastic portion 154 and the second elastic portion 156. The end portion 154*a* of the first elastic portion 154 and the end portion 156*a* of the second elastic portion 156 are separated by the first slit G1. The first slit G1 is formed so as to extend radially from the center point O. In this configuration, the elastic force of the first elastic portion 154 and the second elastic portion 156 acts to close the first slit G1 with the first fixed portion S1 serving as the fixed pivot point.

FIG. 6 is a plan view of the inner conductor 120 and the insulating portion 150 from direction Z2 (the mating direction of the inner conductor 20 of the first coaxial connector R). However, as shown in FIG. 6, the planar profile of both the first elastic portion 154 and the second elastic portion 156 is arcuate, and the first fixed portion S1 at the boundary between the first elastic portion 154 and the second elastic portion 156 is fixed in a single location. The planar profile connecting the first elastic portion 154, the first fixed portion S1, and the second elastic portion 156 is preferably C-shaped with the first slit G1 serving as the opening. Because the second coaxial connector P in the present embodiment has this configuration, the elastic force of the first elastic portion 154 and the second elastic portion 156 acting to close the first slit is transmitted to the first holding portion 124 and the second holding portion 126, where it acts to close the second slit G2. This maintains contact pressure on the inner conductor 20 of the first coaxial connector R and the inner conductor 120 of the second coaxial connector P, and an electrical connection is maintained between them. In this configuration, the elastic force of the first elastic portion 154 and the second elastic portion 156 acts in the X direction and the Y direction. This reduces the thickness of the first elastic portion 154 and the second elastic portion 156 in the Z direction, and enables a more compact second coaxial connector P to be realized.

As shown in FIG. 6, the first slit G1 and the second slit G2 are preferably positioned in the same direction from the first fixed portion S1 (the Y1 direction in FIG. 6). In the configuration of the second coaxial connector P in the present embodiment, the direction in which the first elastic portion 154 and the second elastic portion 156 close the first slit G1 and the direction in which the first holding portion 124 and the second holding portion 126 close the second slit G2 are the same. In addition to the elastic force of the first elastic portion 154 and the second elastic portion 156, the elastic force of the first elastic portion 154 and the second elastic portion 156 closing the first slit G1 can be transmitted to the first holding portion 124 and the second holding portion 126 as force for closing the second slit G2. This maintains contact pressure on and an electrical connection between the inner conductor 20 of the first coaxial connector R and the inner conductor 120 of the second coaxial connector P.

In the second coaxial connector P of the present embodiment, the elastic force of the first elastic portion 154 and the second elastic portion 156 is such that the first elastic portion 154 biases the outer peripheral surface 122*a* of the first holding portion 124 of the inner conductor 120 towards the outer peripheral surface side (center point O side) of the inner conductor 20 of the first coaxial connector R. Similarly, the second elastic portion 156 biases the outer peripheral surface 122*a* of the second holding portion 126 of the inner conductor 120 towards the outer peripheral surface side (center point O side) of the inner conductor 20 of the first coaxial connector R.

In addition to the elastic force of the first holding portion 124 and the second holding portion 126 of the inner conductor, the elastic force of the first elastic portion 154 and the second elastic portion 156 can act in the direction of the inner conductor 20 of the first coaxial connector R (center point O side). This biases the first holding portion 124 and the second holding portion 126 of the first inner conductor 20 towards the outer peripheral surface 122*a* of the inner conductor 120 of the second coaxial connector P more strongly than a coaxial connector without this configuration. As a result, contact pressure is maintained on the inner conductor 20 of the first coaxial connector R and the inner conductor 120 of the second coaxial connector P even though the first coaxial connector R and the second coaxial connector P are smaller. This prevents a reduction in the electrical connection between the first coaxial connector R and the second coaxial connector P, while realizing a smaller first coaxial connector R and a second coaxial connector P.

In the second coaxial connector P in the present embodiment, the insulating portion 150 has a first slit G1 between the first elastic portion 154 and the second elastic portion 156. This causes the elastic force of the first elastic portion 154 and the second elastic portion 156 to close the first slit G1. Because the first elastic portion 154 and the first holding portion 124 are connected and the second elastic portion 156 and the second holding portion 126 are connected, the elastic force of the first elastic portion 154 and the second elastic portion 156 closing the first slit G1 also acts to close the second slit G2.

In the second coaxial connector P of the present embodiment, unlike a coaxial connector without this configuration, contact pressure is maintained on the inner conductor 20 of the first coaxial connector R and the inner conductor 120 of the second coaxial connector P. In this way, any reduction in the electrical connection between the first coaxial connector R and the second coaxial connector P can be prevented. The width of the opening in the second slit G2 in the circumferential direction is preferably greater than the width of the opening in the first slit G2. In this configuration, the end portion 154*a* of the first elastic portion 154 and the end portion 156*a* of the second elastic portion 156 are prevented from establishing contact. As a result, the biasing force of the insulating portion 150 acts reliably on the inner conductor 120.

Figure 7:
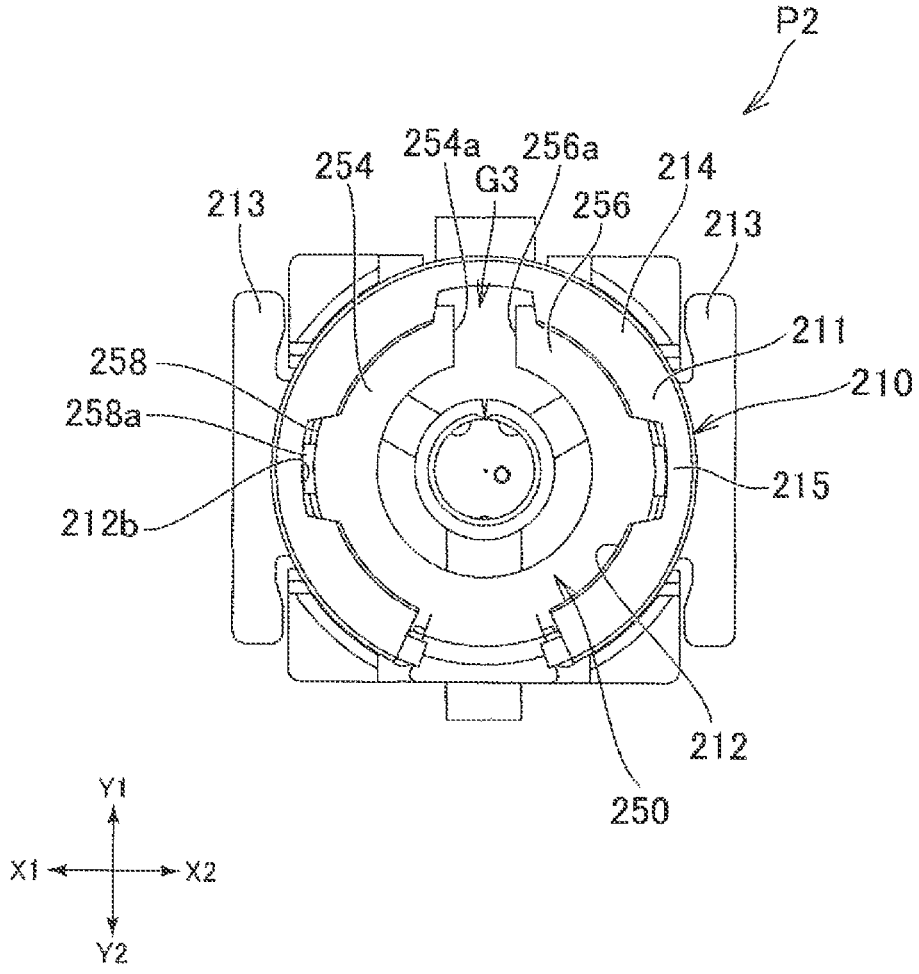
FIG. 7 is a plan view of a third coaxial connector in accordance with a second embodiment of the Present Disclosure.
Figure 8:
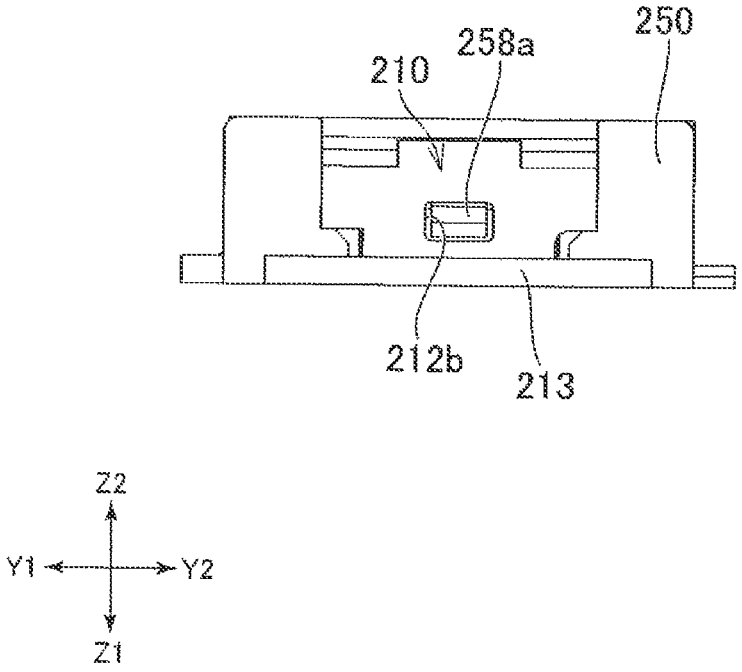
FIG. 8 is a side view of the third coaxial connector of FIG. 7, from Direction X1.

Referring to FIGS. 7-8, in the third coaxial connector P2 of the second embodiment, one portion of the outer peripheral surface 258 of the elastic portion (the first elastic portion 254, the second elastic portion 256) of the insulating portion 250 engages a portion of the inner peripheral surface 212 of the outer conductor 210. In this respect, it differs from the second coaxial connector P of the first embodiment. The following is an explanation of the configuration related to the outer conductor 210 and the insulating portion 250. The rest of the configuration is identical to that of the second coaxial connector P in the first embodiment, and further explanation of this has been omitted.

The first elastic portion 254 and the second elastic portion 256 of the insulating portion 250 in the present embodiment have a protruding portion 258*a* on the outer peripheral surface 258. The protruding portion 258*a* is provided to engage a portion of the inner peripheral surface 212 of the outer conductor 210. A recessed portion 212*b* is provided in the area of the inner peripheral surface 212 of the outer conductor 210 corresponding to the protruding portion 258*a*. The recessed portion 212*b* engages the protruding portion 258*a*, and secures a portion of the first elastic portion 254 and the second elastic portion 256. The recessed portion 212*b* may be a hole passing through a portion of the outer conductor 210 as shown in FIG. 8.

In the third coaxial connector P2 of the present embodiment, a portion (the protruding portion 258*a*) of the outer peripheral surface 258 of the elastic portions (the first elastic portion 254, the second elastic portion 256) of the insulating portion 250 engages a portion (the recessed portion 212*b*) of the inner peripheral surface 212 of the outer conductor 210, which retains the first elastic portion 254 and the second elastic portion 256 robustly. Here, the first elastic portion 254 and the second elastic portion 256 maintain force which closes the third slit G3 separating the end portion 254*a* of the first elastic portion 254 from the end portion 256*a* of the second elastic portion 256.

The third coaxial connector P2 of the Present Disclosure, unlike a coaxial connector without this configuration, maintains contact pressure on the other coaxial connector. This can prevent a reduction in electrical conductivity with the other coaxial connector. In addition, the configuration of the third coaxial connector P2 in the present embodiment prevents molten solder from penetrating onto the mated portion. As shown in FIG. 7, the upper surface 211 (the surface in Direction Z2) of the outer conductor 210 has four mating portions 214 extending towards the center point O, and three linking portions 215 linking the mating portions 214. Because the linking portions 215 are tube-shaped portions of the outer conductor 210, they are deformable in the radial direction of the outer conductor 210.

These mating portions 214 engage the engaging portion of the outer conductor of the other coaxial connector (for example, the engaging portion 12 of the tube-shaped portion 10 of the outer conductor 8 of the first coaxial connector R).

At this time, the outer conductor 210 is pushed apart and deformed by the engaging portion of the outer conductor of the other coaxial connector. However, because of the linking portions 215, excessive deformation can be prevented. There are four mating portions 214 in the present embodiment. However, there may be fewer mating portions 214 such as two or more mating portions as long as the effect is the same.

The present embodiment was explained above with reference to embodiments, but the Present Disclosure is not restricted to these embodiments. Various elements in the embodiments described above may be replaced with elements having the same operations and effects or elements able to achieve the same purpose. For example, as shown in FIGS. 7-8, the coaxial connectors in the present embodiments may include a panel-shaped mounting portion 213 for mounting another electronic device on the board. Also, the coaxial connectors in the present embodiments do not have to be formed using bead processing. For example, sheet-like conductors may be stamped into a tube shape. Also, the recessed portion 212*b* may function as a solder reservoir for molten solder that penetrates from the mounting portion 213. A groove may also be formed in the back surface of the sheet-like mounting portion 213 to serve as a solder reservoir. Penetration by molten solder can be reliably prevented by a recessed portion 212*b* and/or a groove formed in the outer conductive portion 210.

The insulating portion 150 may be made of an elastic material such as rubber. In this configuration, a first slit G1 and first fixed portion S1 may be provided. Here, the elastic force of the insulating portion 150 is applied towards the center point O, and the first holding portion 124 and the second holding portion 126 are biased towards the center point O via the connecting portions 128, 129. There are no particular restrictions on the configuration as long as the first elastic portion 154 and the second elastic portion 156 of the insulating portion 150 bias the first holding portion 124 and the second holding portion 126 towards the center point O. For example, the first elastic portion 154 and the second elastic portion 156 may be U-shaped and open towards Direction Z2.

While a preferred embodiment of the Present Disclosure is shown and described, it is envisioned that those skilled in the art may devise various modifications without departing from the spirit and scope of the foregoing Description and the appended Claims.

What is claimed is:

1. A coaxial connector, the coaxial connector comprising:

an outer conductor, the outer conductor engaging an outer conductor of another coaxial connector;

an insulating portion, the insulating portion being arranged on the inside of the outer conductor, the insulating portion including a first fixed portion, a first elastic portion and a second elastic portion, the first elastic portion being positioned on one end of the first fixed portion and moving elastically using the first fixed portion as a pivot, the second elastic portion being positioned on another end of the first fixed portion and moving elastically using the first fixed portion as a pivot; and an inner conductor, the inner conductor being arranged on the inside of the insulating portion and establishing contact with the outer peripheral surface of the inner conductor of the other coaxial connector, the inner conductor including a second fixed portion, a first holding portion and a second holding portion, the first holding portion being positioned on one side of the second fixed portion, the second holding portion being positioned on another side of the second fixed portion;

wherein:

the first elastic portion biases the outer peripheral surface of the first holding portion towards the outer peripheral surface of the inner conductor of the other coaxial connector; and the second elastic portion biases the outer peripheral surface of the second holding portion towards the outer peripheral surface of the inner conductor of the other coaxial connector.

2. The coaxial connector of claim 1, wherein a portion of the outer peripheral surface of the elastic portions engages a portion of the inner peripheral surface of the outer conductor.

3. The coaxial conductor of claim 1, wherein an end portion of the first elastic portion and an end portion of the second elastic portion are separated by a first slit.

4. The coaxial conductor of claim 3, wherein an end portion of the first holding portion and an end portion of the second holding portion are separated by a second slit, and the first elastic portion, the second elastic portion, the first holding portion are fixed and the second holding portion are fixed.

5. The coaxial connector of claim 3, wherein a portion of the outer peripheral surface of the elastic portions engages a portion of the inner peripheral surface of the outer conductor.

6. The coaxial connector of claim 3, wherein an opening in the first slit is larger than an opening in the second slit.

7. The coaxial connector of claims 6, wherein a portion of the outer peripheral surface of the elastic portions engages a portion of the inner peripheral surface of the outer conductor.

8. The coaxial connector of claim 3, wherein the first slit and the second slit are positioned in the same direction from the first fixed portion.

9. The coaxial connector of claim 8, wherein a portion of the outer peripheral surface of the elastic portions engages a portion of the inner peripheral surface of the outer conductor.

10. The coaxial connector of claim 8, wherein an opening in the first slit is larger than an opening in the second slit.

11. The coaxial connector of claim 10, wherein a portion of the outer peripheral surface of the elastic portions engages a portion of the inner peripheral surface of the outer conductor.

12. The coaxial conductor of claim 3, wherein the insulating portion has an arcuate plan view profile connecting the first elastic portion and the second elastic portion, and has a C-shaped plan view profile connecting the first elastic portion, the first fixed portion and the second elastic portion.

13. The coaxial conductor of claim 12, wherein the inner conductor has an arcuate plan view profile connecting the first holding portion and the second holding portion, and has a C-shaped plan view profile connecting the first holding portion, the second fixed portion and the second holding portion.

14. The coaxial connector of claim 12, wherein a portion of the outer peripheral surface of the elastic portions engages a portion of the inner peripheral surface of the outer conductor.

15. The coaxial connector of claim 12, wherein an opening in the first slit is larger than an opening in the second slit.

16. The coaxial connector of claim 15, wherein a portion of the outer peripheral surface of the elastic portions engages a portion of the inner peripheral surface of the outer conductor.

17. The coaxial connector of claim 12, wherein the first slit and the second slit are positioned in the same direction from the first fixed portion.

18. The coaxial connector of claim 17, wherein a portion of the outer peripheral surface of the elastic portions engages a portion of the inner peripheral surface of the outer conductor.

19. The coaxial connector of claim 17, wherein an opening in the first slit is larger than an opening in the second slit.

20. The coaxial connector of claim 19, wherein a portion of the outer peripheral surface of the elastic portions engages a portion of the inner peripheral surface of the outer conductor.

* * * * *